US008689468B2

(12) United States Patent
Curley

(10) Patent No.: US 8,689,468 B2
(45) Date of Patent: Apr. 8, 2014

(54) FOOTWEAR CLEAT

(76) Inventor: John J. Curley, Boston, MA (US)

( * ) Notice: Subject to any disclaimer, the term of this patent is extended or adjusted under 35 U.S.C. 154(b) by 548 days.

(21) Appl. No.: 12/912,419

(22) Filed: Oct. 26, 2010

(65) Prior Publication Data

US 2011/0232136 A1 Sep. 29, 2011

Related U.S. Application Data

(60) Provisional application No. 61/279,704, filed on Oct. 26, 2009.

(51) Int. Cl.
*A43B 5/00* (2006.01)

(52) U.S. Cl.
USPC ..... 36/67 R; 36/67 D; 36/134

(58) Field of Classification Search
USPC ..... 36/67 R, 67 D, 134
See application file for complete search history.

(56) References Cited

U.S. PATENT DOCUMENTS

| | | | | |
|---|---|---|---|---|
| 6,023,860 | A * | 2/2000 | McMullin | 36/127 |
| 6,052,923 | A * | 4/2000 | McMullin | 36/127 |
| 6,233,850 | B1 * | 5/2001 | Peabody | 36/134 |
| 6,305,104 | B1 * | 10/2001 | McMullin | 36/127 |
| D452,062 | S * | 12/2001 | Savoie | D2/962 |
| D452,947 | S * | 1/2002 | Terashima | D2/962 |
| 7,040,043 | B2 * | 5/2006 | McMullin | 36/127 |
| 8,245,422 | B2 * | 8/2012 | Krikorian et al. | 36/134 |
| 2001/0011429 | A1 * | 8/2001 | Peabody | 36/134 |
| 2002/0078603 | A1 * | 6/2002 | Schmitt, Jr. | 36/134 |
| 2004/0010944 | A1 * | 1/2004 | McMullin | 36/127 |
| 2007/0277399 | A1 * | 12/2007 | Dow et al. | 36/134 |
| 2009/0223088 | A1 * | 9/2009 | Krikorian et al. | 36/127 |

* cited by examiner

*Primary Examiner* — Marie Patterson
(74) *Attorney, Agent, or Firm* — Bay State IP, LLC

(57) ABSTRACT

A dynamic golf cleat having a plurality of composite dynamic traction elements, the wherein the elements preferably assume an angle with respect to the plane of the shoe sole, to allow room for deflection toward the shoe sole under load. The dynamic traction element is preferably formed of an elastomeric material such as thermoplastic urethane. A hub portion having a threaded attachment means is preferably oriented perpendicular to the plane of the shoe sole. Extending outwardly in a radial manner from the hub portion is a plurality of embedded thin tensile members oriented to be integrally formed within each flexible traction element. Each individual tensile member is centrally located within each dynamic traction element creating a distinct upper surface area and a lower surface area, within each dynamic traction element. Said sections of the dynamic traction elements have facing surfaces joined by a thin tensile member sections. These thin tensile member sections are molded integral with the two flexible traction element, an upper surface area and a lower surface area.

17 Claims, 10 Drawing Sheets

FOOTWEAR CLEAT

CROSS REFERENCE TO RELATED APPLICATION

This application claims the benefit of and takes priority under 35 U.S.C. §119 to U.S. Patent Application No. 61/279,704 filed on Oct. 26, 2009.

BACKGROUND OF THE INVENTION

1. Field of the Invention

This invention relates to a dynamic traction element, and more particularly to a dynamic traction element construction wherein a flexible elastomeric traction arm element is designed and configured to yield an improved dynamic traction element providing for a faster rate of deformation return following compression.

2. Description of the Related Prior Art

Prior dynamic traction element constructions include dynamic traction elements having pivoted or articulated sections joined together in a central hub area; these flexible traction elements are composed of a singular material, typically a resilient thermoplastic urethane dynamic element configuration.

There are three forces or stresses that may act on a material, all of which are intermolecular: sheer or tensile, compression, and torque. Sheer or tensile stress represents a force acting on an object, which is being pulled apart. Compression stress represents a force acting on an object that is being pushed together. Lastly, torque represents a rotational or twisting stress on an object.

The instant invention primarily deals with both sheer and compression stresses on a material; additionally these effects on the material may also be influenced by water and its associated contaminants, as along with ultra violet radiation.

Polyurethane comprises a series of urethane molecules linked together by hydrogen bonds. In contrast, water which may be found on the golf course for instance, would not be considered pure water, rather there may be additional compounds dissolved in the water, such as hydrocarbons which themselves are a series of long carbon chains with hydrogen atoms attached around the outside of the chain. Therefore, moisture from a golf course will wick up into the polyurethane (water will wick up into nylon as well, but nylon is not as reactive as urethane to hydrocarbons). As the water evaporates, the hydrogen atoms from the hydrocarbons will release from the chain forming free-floating hydrogen radicals. Since the hydrogen bonds holding the urethane molecules together require a lot of energy to maintain, the tendency will be for the urethane molecules to release the hydrogen bond linking it to the next urethane molecule and substitute in its place a free floating hydrogen atom, which in its free-floating nature requires less energy. As a result, the bond between the hydrogen atoms requires less energy to maintain than the bond between the hydrogen and urethane molecules; as such the energy difference favors the direction the polyurethane molecules ultimately undertake. The result on a golf cleat is that over time, more and more intermolecular bonds will break, thereby will lose a cleat's resiliency to quickly return to a cleat's original position, and instead will remain in a compressed set.

SUMMARY OF THE INVENTION

The instant invention, as illustrated herein, is clearly not anticipated, rendered obvious, or even present in any of the prior art mechanisms, either alone or in any combination thereof.

The instant invention comprises a dynamic golf cleat having a plurality of composite dynamic traction elements; the elements preferably assume an angle with respect to the plane of the shoe sole, to allow room for deflection toward the shoe sole under pressure load. Each dynamic traction element is preferably formed of an elastomeric material including, but not limited to thermoplastic urethane. A series of embedded thin tensile members are disposed to be oriented and integrally formed within each flexible traction element, and are preferably molded within each dynamic traction element. Each individual tensile member is centrally located within each corresponding dynamic traction element. This orientation allows for the creation within each dynamic traction element of distinct upper and lower surface areas. As such, these sections of the dynamic traction elements possess facing surfaces which are joined by the thin tensile member sections.

According to one embodiment of the instant invention, two elastomeric sections separated by a thin tensile member define a dynamic traction element, and within these dynamic traction elements are areas defined as stress concentration zones, or stress lenses. These stress lenses are preferably comprised of ridges and/or grooves oriented and disposed to be integrally formed within each dynamic traction elements. The ridges or grooves are designed to concentrate or focus the stresses caused by deformation from broad areas of the elastomeric dynamic traction elements into smaller concentrated areas of the elastomeric elements. As a result, this concentration of stresses, such as compression stress or tensile stress require more energy to deform the material, than if the stresses were more broadly dispersed within its molecular structure. Therefore, the faster deformation return in this embodiment may be attributed to the embedded and integrally molded tensile member surface conforming to the curved sections of a plurality of traction teeth and which is disposed to be substantially bendable and able to conform to straight teeth sections.

It is known in the art that when two materials with two different flex modulus values are surface bonded, they create a material that has a higher flex modulus than the simple sum of the independent flex modulus of the two materials. Therefore, the return speed of a material from deformation (for example under pressure load) to its original pre-deformation position of the composite dynamic traction element (i.e. the dynamic traction element with the bonded core, is about six times the speed of the non-composite dynamic traction element).

The increased recovery speed for a material may desired in any activity, but possesses increased significance when a plurality of traction elements are flexing under pressure loads typically encountered during sports that require any type of running by a player. The recovery rate on a non-composite or "simple" dynamic traction element is does not allow the dynamic traction element to its original position following deformation prior to each new stride a running player undertakes. Therefore once a player starts running, a simple dynamic traction element will not be able to fully recover its shape until the player stops running and the load is removed for a sufficient time interval, such as the time the shoe is of the ground during a typical walking stride of a golfer for example.

Finally, the premature aging of the elastomeric material due to wicking contaminated water, such as dew-covered grass with petroleum based pesticides added would be delayed by the addition of the core member and its inherent improved performance characteristics, as well as the tendency of the core material to be significantly less sensitive to the effects of any petroleum based pesticides. Ultraviolet radiation, another aging enhancer will also have less effect on the composite dynamic traction elements, again because the core material is less sensitive to begin with but also because it is protected to a degree by the outer covering of the elastomeric material.

Therefore, to summarize, in a dynamic cleat whereby the flexible element is made from a single material of a single durometer or flex modulus, an individual is required to rely on a very slow process in order for each flexible dynamic element to return to their original pre-stressed position. This process is known as entropy and encompasses the universal law that all things will eventually return to their lowest energy state. Thus, for a deformed flexible element, once the deforming stress is removed, the lowest energy state for the molecules of the flexible element would be defined as their original locations. In one embodiment, this state may be described as the location and shape of each flexible element upon reaching a solid state.

The molecules of each flexible element may be comprised of long chains of carbon atoms surrounded primarily by hydrogen atoms with the occasional nitrogen, oxygen or sulfur atoms forming right angles, thereby allowing the molecule to become a more rigid building block upon bonding with other molecules. Typically, these atoms are held together as a result of not possessing the correct amount of neutral electric charge to assume a state of rest.

As such, once a force pushes the flexible material and deforms it, the electrons closest to the deformed areas require more energy to stay locked together. However, sometimes the force is too great and the electron bonds fail and the parts subsequently break apart. Returning now to the deformed dynamic element; the force applied and the distance the deformation takes place is low enough that the parts keep their electron bonds and simply want to go back to the un-deformed shape where they can reach their lowest energy state.

Since the molecular chains do not have a chance to all get in line before they cooled and solidified, the process of returning to its original shape is not completely uniform. As some electrons pull together, they often times need to push other electrons apart momentarily in order to get back into shape. This process, entropy is therefore slow and itself not very energetic. Two weak electron bonds battling each other to get back in line, momentarily creating an opposing force situation can reduce the energy component of that particular movement to near zero, making it agonizingly slow.

Therefore, by introducing a tensile member embedded into the dynamic traction material will alter the chemical and mechanical properties of the instant invention. The tensile member that would be embedded would optimally and preferably match as close as possible the material characteristics as the over-molded elastomeric material. Since the tensile member is made of a much denser, stronger, more rigid material, it may be quite thin. Additionally, close to the thickness it would need merely to hold itself up in position in order to hold its shape prior to the injection of the elastomeric material, likely only several thousands of an inch thick.

Moreover, the tensile member is preferably put in place to put more order into the stresses that will occur once the dynamic element is deformed by being pushed into the shoe sole surface. For the most part, all the molecules above the tensile member will go into a tensile stress load condition and the molecules below the tensile member will go into a compression stress load condition. This alone increases the organization level of stress load on the material dramatically. Add to this organized state the fact that the molecules attached to both the top and bottom of the tensile member stay attached as the tensile member deforms as it bends. This puts a organized concentrated motion of forces pulling apart (Tensile stress) of the elastomeric material above the tensile member and pushing together (Compression stress) the elastomeric material below the tensile member.

Not only have the forces involved been separated and located, the tensile stresses above the member and the compression stresses below the member but we further concentrate the larger stronger stresses within each side closest to the member itself. More organization of forces at work means more concentrated energies at work when it is time for the dynamic traction element to return to its uncompress, pre-stressed shape.

Using similar approaches to concentrating the force loads, the longitudinal ridges along the top surface of the traction element and the lateral grooves on the bottom surface are additional methods that generally act as stress organizers as well, further concentrating the forces involved in the deformation of the traction element. Therefore they act to help speed the return to shape though typically not as effectively as the embedded tensile member does.

There has thus been outlined, rather broadly, the more important features of the a dynamic traction election in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

DETAILED DESCRIPTION OF THE PREFERRED EMBODIMENT

Figure 1:
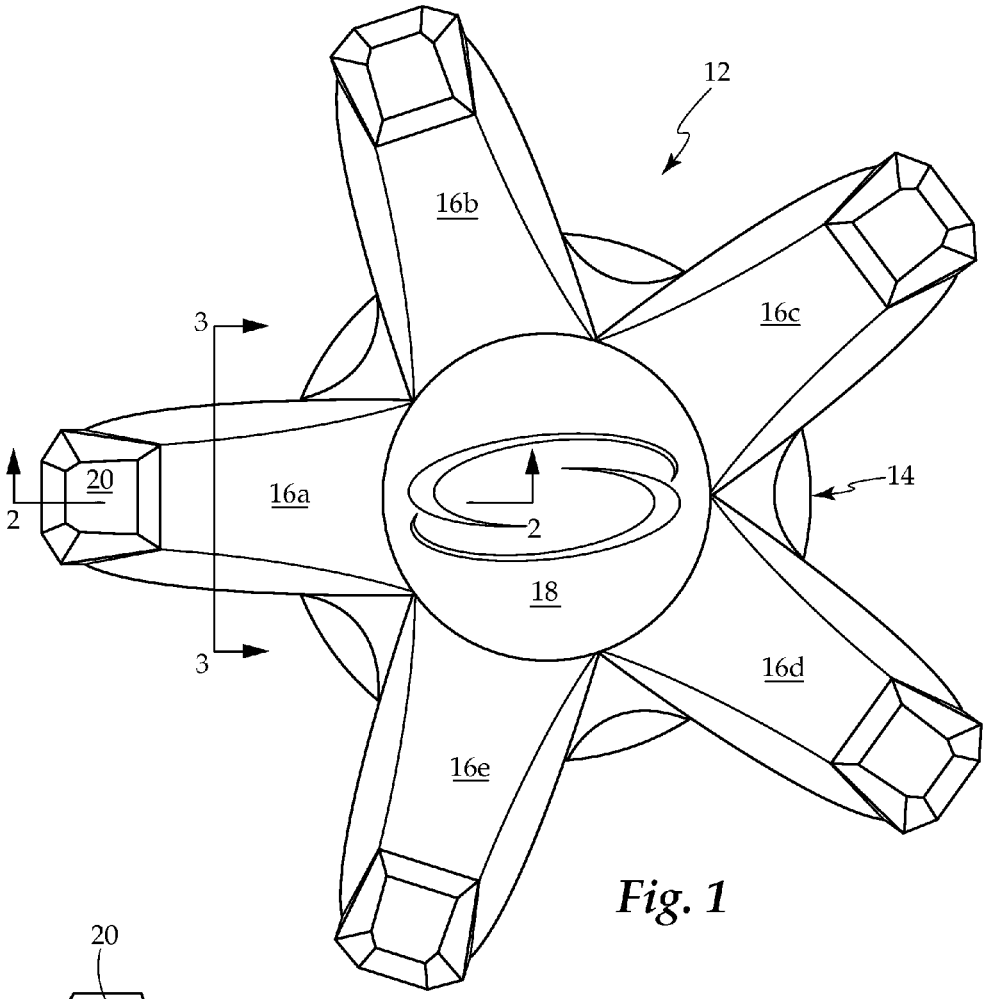
FIG. 1 is a plan view of a typical prior art dynamic cleat.

FIG. 1 illustrates a plan view of a typical prior art dynamic cleat 12 comprised of a central hub 14 having a central wear area 18. The prior art dynamic cleat 12 is also comprised of a plurality of dynamic traction elements, in this example 16*a* trough 16*e*. Each dynamic traction element is further comprised of raised traction teeth portions 20 for providing enhanced traction.

Figure 2:
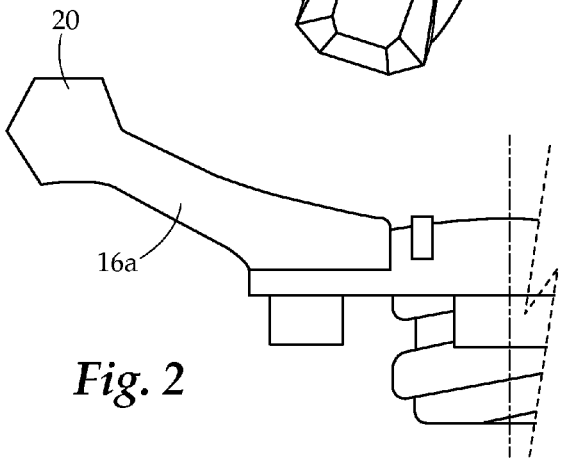
FIG. 2 is a sectioned, longitudinal side elevation view of a dynamic traction element taken along section line 2-2 of FIG. 1.

FIG. 2 illustrates a sectioned, longitudinal side elevation view of a dynamic traction element taken along section line 2-2 and shows the simple non-composite dynamic traction element 16*a* with its traction tooth area 20 along with central hub 14 having and the convex central wear area 18. The convex central wear area 18 being of a high durometer provides a compression limit of the spikes on hard surfaces such as a paved area, thus helping extend wear damage characteristics of the spike.

Figure 3:
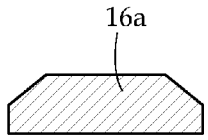
FIG. 3 is a sectioned, lateral elevation view of a dynamic traction element taken along section line 3-3 of FIG. 1.

FIG. 3 illustrates a sectioned, lateral elevation view of a dynamic traction element taken along section line 3-3 and shows the simple non-composite dynamic traction element 16*a*.

Figure 4:
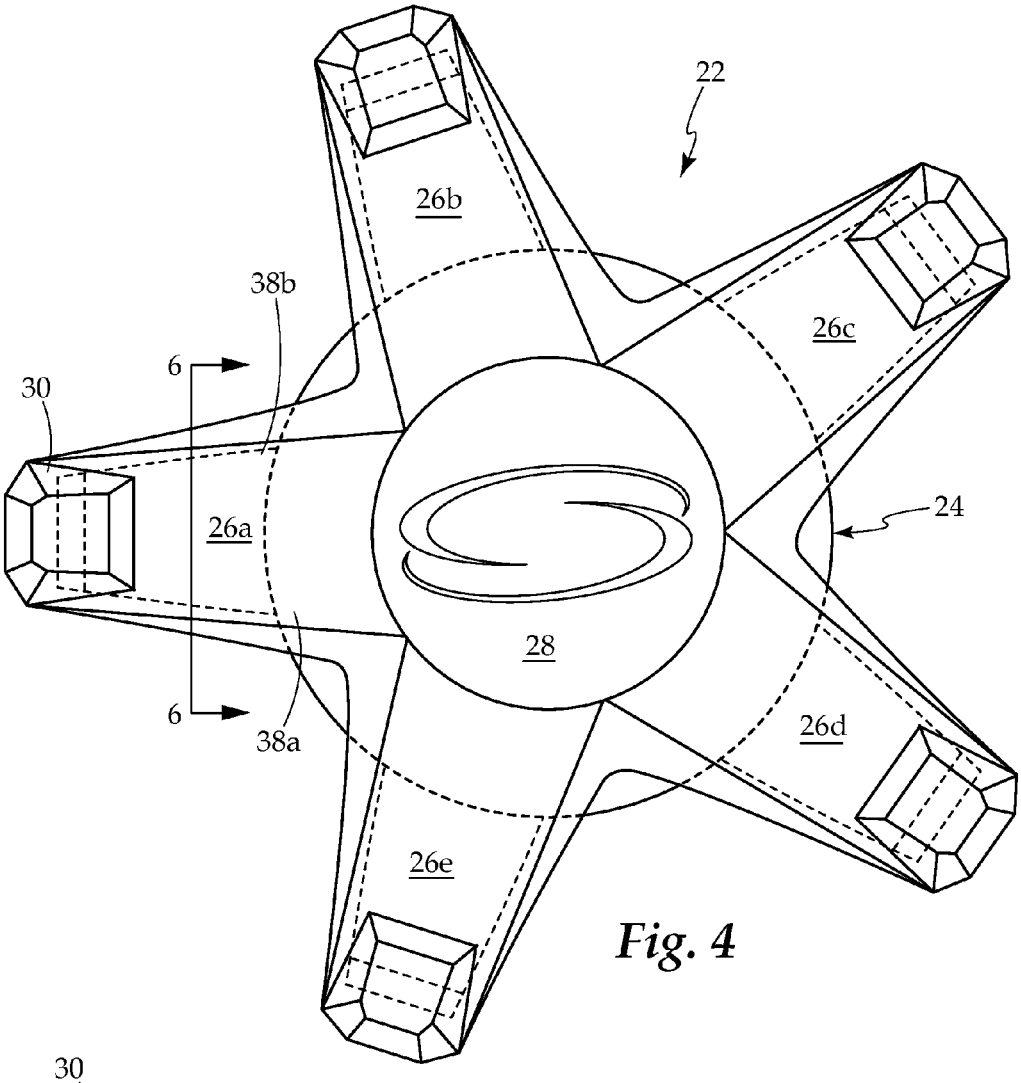
FIG. 4 is a plan view of the present invention dynamic cleat.

FIG. 4 illustrates a plan view of the present invention dynamic cleat 22 along with the central hub 24 having a central wear area 28. As part of the central hub portion 28, a plurality of tensile members 32*a* through 32*e* are shown in dotted lines and preferably embedded within a plurality of dynamic traction elements 26*a* through 26*e* respectively. Each dynamic traction element 26 is further comprised of a raised traction teeth portion 30 preferably for providing enhanced traction.

Figure 5:
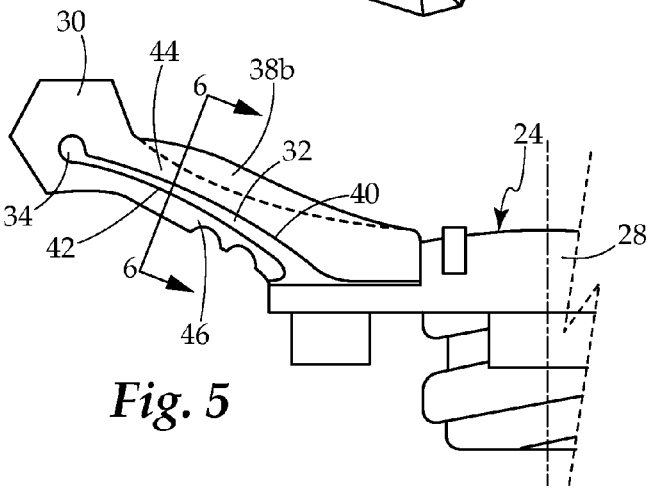
FIG. 5 is a sectioned, longitudinal side elevation view of a dynamic traction element taken along section line 5-5 of FIG. 4

FIG. 5 illustrates a sectioned, longitudinal side elevation view of a dynamic traction element 26 taken along section line 5-5 and shows the composite dynamic traction element 26*a* with a corresponding traction tooth area 30, along with the central hub portion 24 having a convex central wear area 28. The convex central wear area 28 is preferably of a high durometer to provide a compression limit of the spikes on hard surfaces such as a paved area, thus helping extend wear damage characteristics of the spike. Furthermore, as discussed in FIG. 5, each dynamic traction element 26 includes a substantially embedded tensile member 32 having a raised end ridge 34. Each embedded tensile member 32 is preferably chemically bonded to an associated surface 44 and 46 of the elastomeric material of the dynamic traction element 26*a*. To further provide bonding strength the raised end ridge 34 may provide an added mechanical bonding function. Also shown on composite dynamic traction element 26*a* is a longitudinal ridge 38*b* on the top tension side of the tensile member 32 and lateral notches 36 on the compression side of the tensile member, which will be explained in more detail when describing FIGS. 11A-11C.

Figure 6:
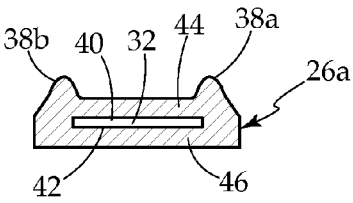
FIG. 6 is a sectioned, lateral elevation view of a dynamic traction element taken along section line 6-6 of FIG. 4.

FIG. 6 illustrates a sectioned, lateral elevation view of a dynamic traction element taken 26 along section line 6-6 and shows more clearly the longitudinal ridges 38*a* and 38*b* on the top tension side of the tensile member 32 preferably embedded within the composite dynamic traction element 26*a*.

Figure 7:
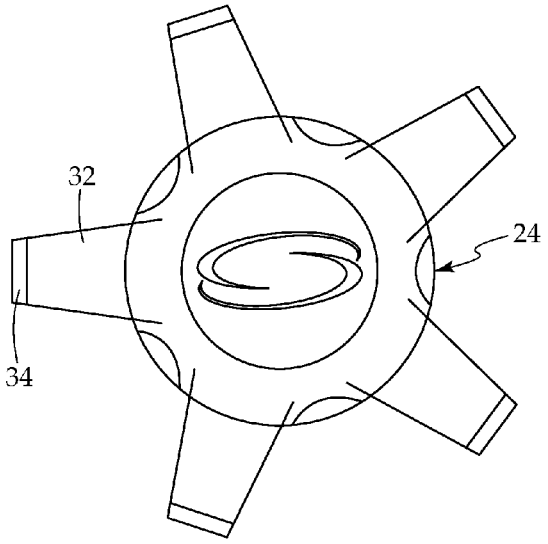
FIG. 7 is a top view of the threaded base shown in FIG. 4.

FIG. 7 is a top view of the embedded tensile members 32 and their threaded base 24. The wings that extend away from the center are the integral molded tensile members 32*a* through 32*e*. Shown on the ends of the tensile members are integrally molded ridges 34*a* through 34*e* that are disposed to create the mechanical bonds that exist on the ends. These mechanical bonds will assist the chemical bonds that will occur between the urethane and the nylon material on their contacting upper and lower surfaces in maintaining structural integrity.

Figure 8:
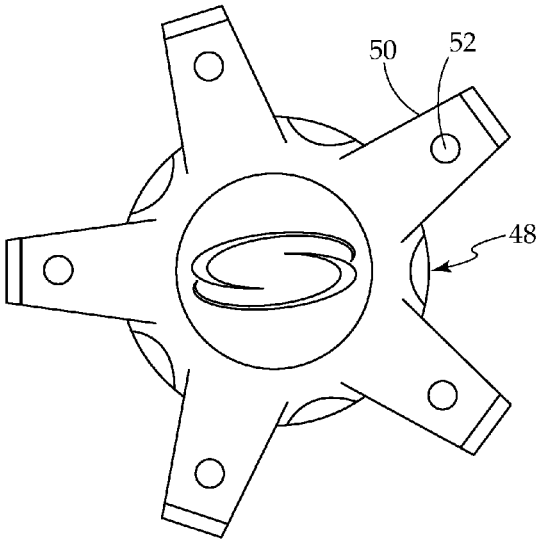
FIG. 8 illustrates a second embodiment of the threaded base shown in FIG. 4 and is a top view of the embedded tensile members and their threaded base.

FIG. 8 illustrates a second embodiment and is a top view of the embedded tensile members 32 and their threaded base 48. The wings that extend away from the center are the integral molded tensile members 50*a* through 50*e*. Shown on the surface of the tensile members are the integrally molded holes 52*a* through 52*e* that create the mechanical bonds that exist between the tensile members and their associated dynamic traction members. These mechanical bonds will assist the chemical bonds that will occur between the urethane and the nylon material on their contacting upper and lower surfaces in maintaining structural integrity.

Figure 9:
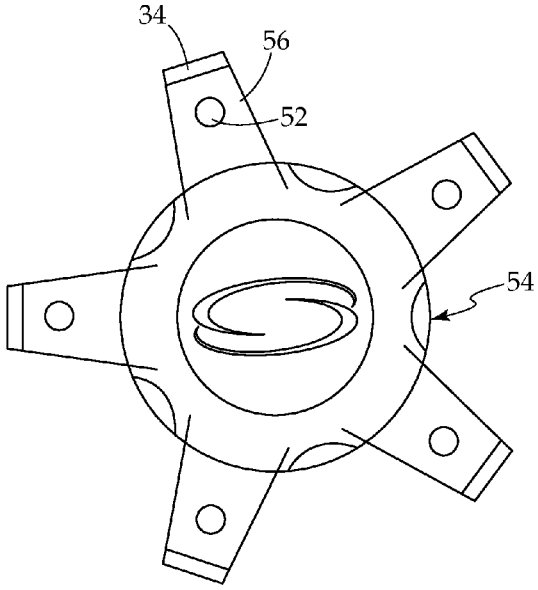
FIG. 9 illustrates a third embodiment of the threaded base shown in FIG. 4 and is a top view of the embedded tensile members and their threaded base.

FIG. 9 illustrates a third embodiment and is a top view of the embedded tensile members and their threaded base 54. The wings that extend away from the center are the integral molded tensile members 56*a* through 56*e*. Shown on the ends of the tensile members are the integrally molded ridges 34*a* through 34*e* along with the integrally molded holes 52*a* through 52*e* both of which will create the mechanical bonds that exist between the tensile members and their associated dynamic traction members. These mechanical bonds will assist the chemical bonds that will occur between the urethane and the nylon material on their contacting upper and lower surfaces in maintaining structural integrity.

Figure 10A:
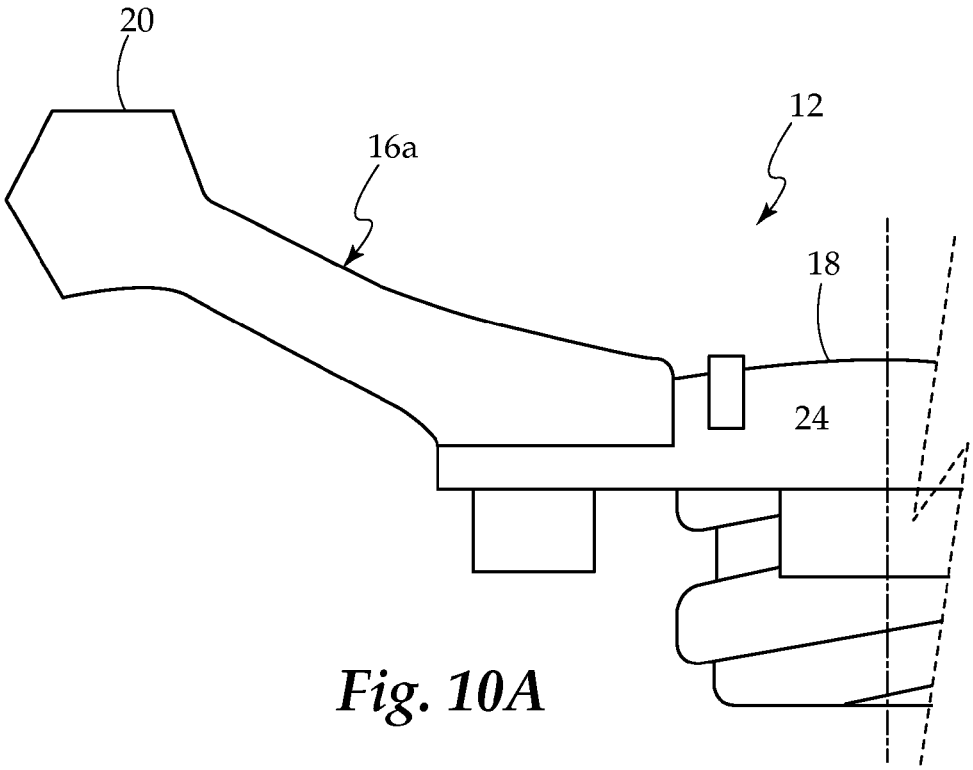
FIG. 10A is a sectioned, longitudinal side elevation view of a dynamic traction element taken along section line 2-2 of FIG. 1 and is similar to the figure as shown in FIG. 2.

FIG. 10A is a sectioned, longitudinal side elevation view of a dynamic traction element taken along section line 2-2 and shows the simple non-composite dynamic traction element 16*a* with its traction tooth area 20 along with a central hub portion 14 having a convex central wear area 18, the same position as shown in FIG. 2. In this figure, the dynamic traction element 16*a* is in an uncompressed relaxed state.

Figure 10B:
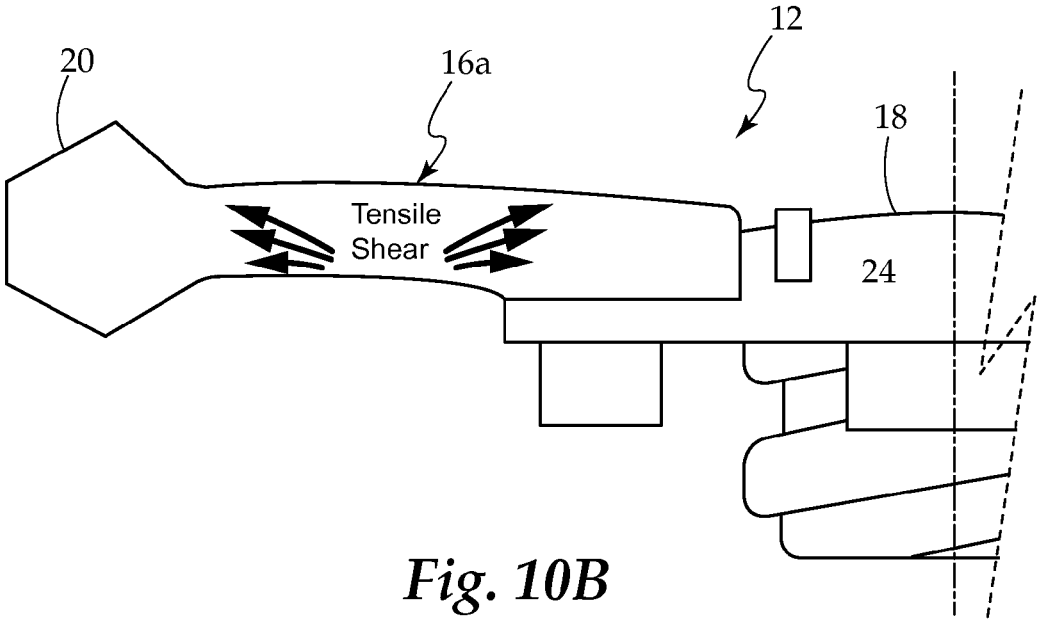
FIG. 10B is a sectioned, longitudinal side elevation view of a dynamic traction element taken along section line 2-2 of FIG. 1 and is shown when flattened by a force is acting on dynamic traction elements.

FIG. 10B is a sectioned, longitudinal side elevation view of a dynamic traction element 16*a* taken along section line 2-2 and shows the simple non-composite dynamic traction element 16*a* with its traction tooth area 20 along with a central hub 14 having a convex central wear area 18, the same position as shown in FIG. 2. Note the dynamic traction element is in the compressed stressed state. As the urethane molecules in the wings of the cleat cure, their relaxed state is at an upward angle as shown in FIG. 10A. When flattened a force is acting on these wings causing a tensile stress as shown in FIG. 10B. The stress is at the molecular level between the bonds holding the urethane molecules together. It is an undefined relaxed stress that puts all of the molecules under some tensile sheer. There exists little energy to reduce the molecules to their original upward angled position. Thus when the force is removed the return will be very gradual.

Figure 11A:
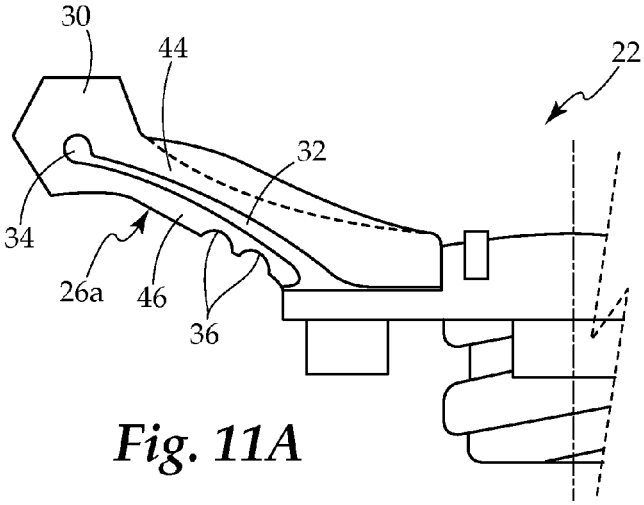
FIG. 11A is a sectioned, longitudinal side elevation view of a composite dynamic traction element taken along section line 5-5 of FIG. 4 and is similar to the figure as shown in FIG. 2.

FIG. 11A is a sectioned, longitudinal side elevation view of a dynamic traction element taken along section line 5-5 and shows the composite dynamic traction element 26*a* with a corresponding traction tooth area 30 along with a central hub portion 24 having a convex central wear area 28. The convex central wear area 28 being of a high durometer provides a compression limit of the spikes on hard surfaces such as a paved area, thus helping extend wear damage characteristics of the spike. Also shown in FIG. 5 are an embedded tensile member 32 and the raised end ridge 34. The embedded tensile member 32 is chemically bonded to the associated surfaces 44 and 46 of the elastomeric material of the dynamic traction element 26*a*. To further provide bonding strength, the raised end ridge 34 provides an added mechanical bonding function. Also shown on composite dynamic traction element 26*a* is longitudinal ridge 38*b* on the top tension side of the tensile member 32 and lateral notches 36 on the compression side of the tensile member.

Figure 11B:
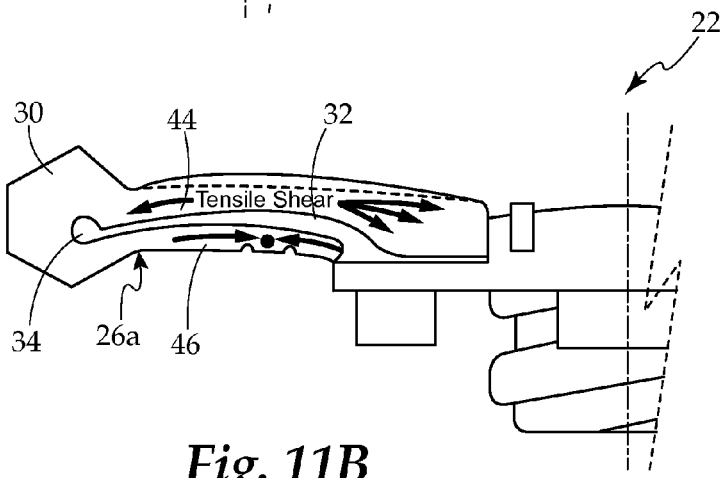
FIG. 11B is a sectioned, longitudinal side elevation view of a composite dynamic traction element taken along section line 5-5 of FIG. 4 and is shown when flattened by a force acting on the dynamic traction elements.
Figure 11C:
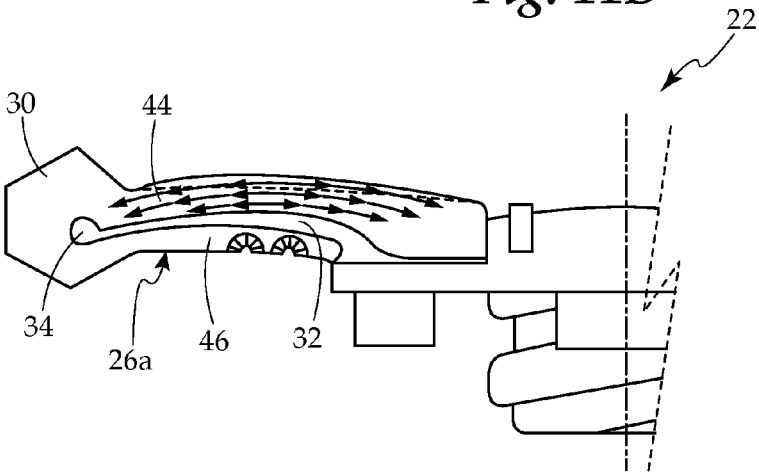
FIG. 11C is a sectioned, longitudinal side elevation view of a composite dynamic traction element taken along section line 5-5 of FIG. 4 and is shown when flattened by a force acting on the dynamic traction elements.

FIG. 11B is a sectioned, longitudinal side elevation view of a dynamic traction element taken along section line 5-5 and shows the composite dynamic traction element 26*a* with its traction tooth area 30 along with a central hub portion 24. Note the dynamic traction element is in the compressed stressed state. FIG. 11B further shows the tensile member 32 compressed with the force being separated into two different stresses, each acting on the tensile member 32 in a different manner. Above the tensile member 32 the stresses experienced within the elastomeric material consists of primarily tension (i.e. the molecules have a pressure applied that wants the shear them apart). The tensile member 32 itself sets up this separation of stress forces.

Because the elastomeric material is essentially chemically and mechanically fused to the tensile member itself, it creates a setting whereby the elastic material above the tensile member is primarily under tension and the elastomeric material below the tensile member is primarily under compression stress. In short, tensile stress exists above the embedded tensile member and compression stress exists below. When a general broad tensile stress is separated, making one side compression and one side tension, the stress is concentrated which gives the stress more energy resulting in the elastomeric material. Thus, in this case the polyurethane will have more energy to spring back into shape. The lateral notches on the compression side of the tensile member help focus the stress even, more making it more concentrated. Although not shown, the stresses and dynamics that are occurring to the urethane are also occurring to the embedded nylon tensile member and since nylon has a much more dense molecular structure its tendency to return to its original shape is even greater.

FIG. 11B shows in a rough manner the directions and types of stresses taking place within the elastomeric material itself. Broadly speaking above the tensile member when the dynamic element is deformed downward and the material is put under shear stress, what is happening is the molecules are stress in such a way as they want to shear apart. It is simply the covalent bonds of the electrons holding together that prevent the breakdown and separation of the material and ultimately failure of the part. That force to pull the molecules apart is a tensile shear. Tensile meaning stretching force and shear meaning ultimately slide by after bond failure. Ironically compression forces under the tensile member though a force pushing the parts together is still ultimately a shearing action. Under a compression failure the covalent bonds fail and the molecules simple slide by in the opposite direction appearing to compress but in essence it is still considered a shearing event, which is why in the drawings the force is denoted a compression shearing action.

FIG. 11C is again a sectioned, longitudinal side elevation view of a dynamic traction element taken along section line 5-5 and shows the composite dynamic traction element 26*a* with its traction tooth area 30 along with a central hub portion 24; it is included in order to more clearly define the localized shearing action specifically in relation to the ridges and grooves designed to focus and concentrate the shearing forces into more compact areas, thus increasing the stress on the localized molecules resulting in more localized strain and therefore more localized recovery, which results in faster more robust molecular recovery.

Figure 12B:
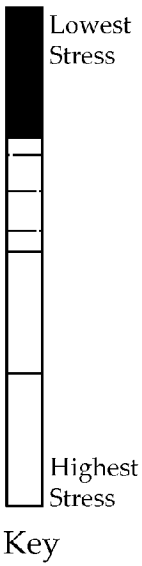
FIG. 12B is a sectioned, lateral elevation view of a dynamic traction element taken along section line 6-6 of FIG. 4 also showing color coded stress concentrations correlated to the color key shown.
Figure 12B:
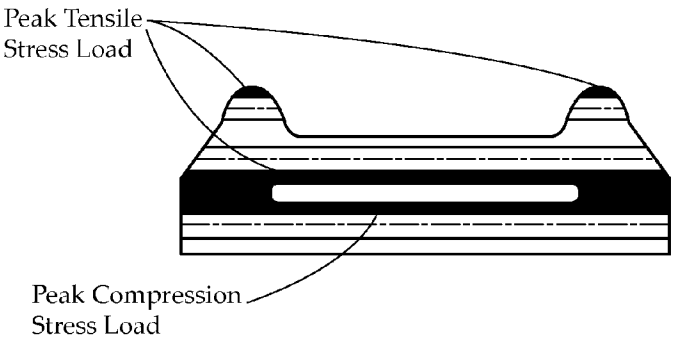
Figure 12A:
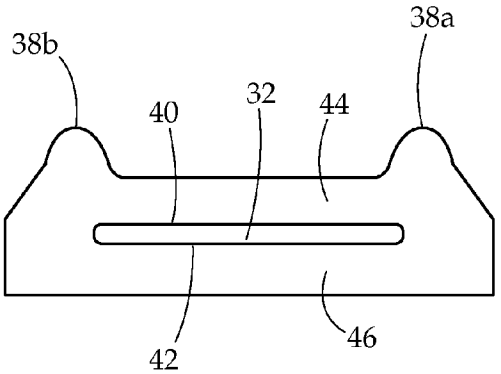
FIG. 12A is a sectioned, lateral elevation view of a dynamic traction element taken along section line 6-6 of FIG. 4.

FIG. 12A is a sectioned, lateral elevation view of a dynamic traction element taken along section line 6-6 and shows more clearly the longitudinal ridges 38*a* and 38*b* on the top tension side the tensile member composite dynamic traction element 26*a*. This is the same view used as FIG. 6 earlier. FIG. 12B show the cross sections of the preferred embodiment that were originally shown in FIG. 12A and FIG. 6, with the addition of coding to show the concentration levels of stress forces while under load conditions; the color gradations on FIG. 12B shows the distribution of stress levels on the dynamic traction elements; using the key, the concentration of highest stress, will be near the surface of the embedded tensile members or in the ridges; the high stress levels at the chemical bonded surfaces, are where the tensile members 32 are bonded to the elastomeric material of dynamic traction element 26. The top surface 40 of each tensile member 32, deals with a tensile force applied by the tensile forces within the area 44 of the dynamic element 26 that is bonded to the surface of each dynamic traction element 26. Meanwhile the bottom surface 42 of each tensile member 32, deals with a compression force applied by the compression forces within the area 46 of the dynamic element 26 that is bonded to the surface of dynamic traction element 26. A further concentration of forces is achieved by the addition of longitudinal ridges 38*a* and 38*b* running along the top surface of dynamic traction element 26. These ridges although designed to concentrate a force that is below its deformation threshold, now are disposed to apply a larger force to the elastomeric material which in turn applies a larger opposite force to recover from the deformation, thus adding to the faster recovery rate, or return rate of the overall compression cycle time.

Figure 13B:
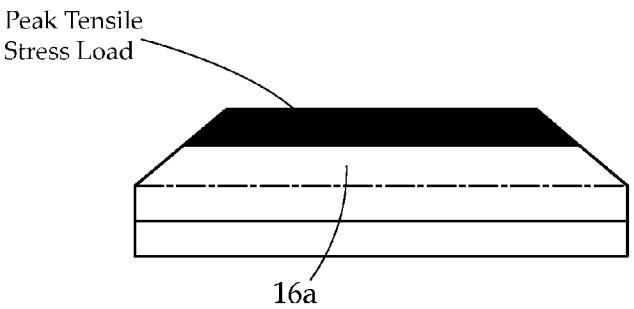
FIG. 13B is a sectioned, lateral elevation view of a dynamic traction element taken along section line 3-3 of FIG. 1 also showing color coded stress concentrations correlated to the color key shown.
Figure 13A:
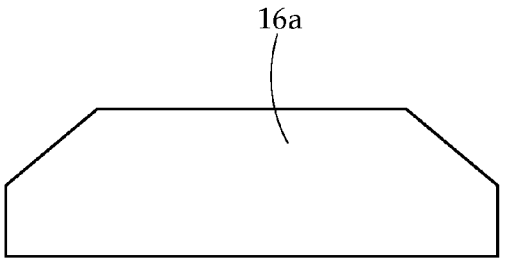
FIG. 13A is a sectioned, lateral elevation view of a dynamic traction element taken along section line 3-3 of FIG. 1.

FIG. 13A is a sectioned, lateral elevation view of a prior art dynamic traction element taken along section line 3-3 and shows the simple non-composite dynamic traction element 16. The lack of an embedded tensile member and top surface ridges is evident.

FIG. 13B is a sectioned, lateral elevation view of a prior art dynamic traction element taken along section line 3-3 and shows the simple non-composite dynamic traction element 16 with the addition of color coding to show the concentration levels of stress forces while under load conditions. The color gradations on FIG. 12B show where the stress will be highest and lowest. Using the key, the concentration of highest stress, is only the tensile stresses which occur broadly throughout the elastomeric material but is more concentrated closest to the top outside surface, where tensile stress levels are at there highest. The lack of an embedded tensile member and top surface ridges is evident in the lack of opposing stress forces and concentration areas. The result is a sluggish return speed from compression forces and an overall slow cycle time.

Figure 14:
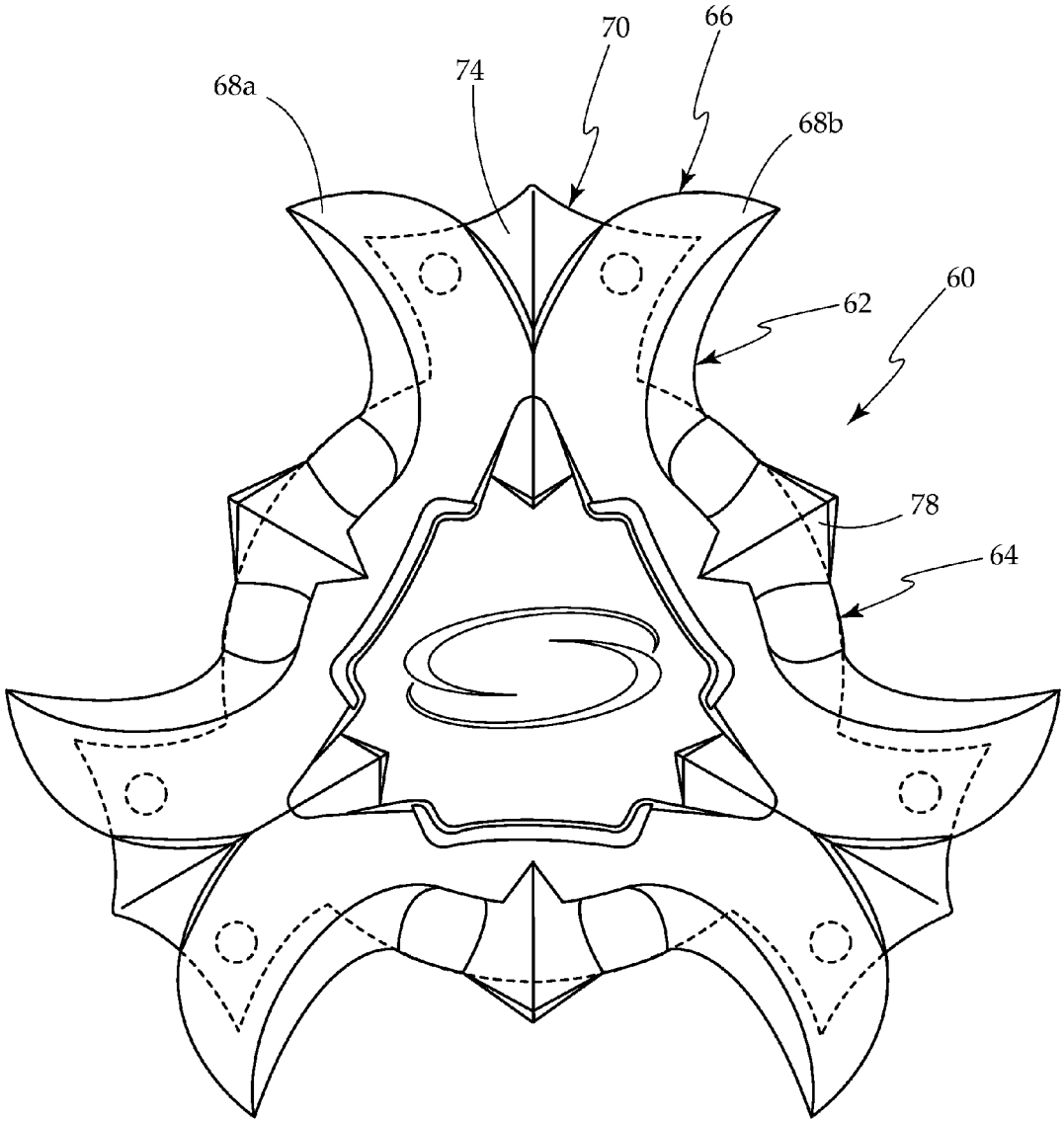
FIG. 14 shows an alternate embodiment with three dynamic elements and three tensile members.

FIG. 14 illustrates a plan view of an alternate embodiment dynamic cleat 60 with an elastomeric flexible dynamic traction portion 62 having three dynamic element 68*a* 68*b* and 68*c* over-molded onto three embedded tensile members, 70*a* through 70*c*, each of which includes dual independent embedded tensile members units 72*a* and 72*b* that are embedded into corresponding dynamic element 68*a*, 68*b* and 68*c*. Also as part of the elastomeric overlay is a plurality of molded soft but static traction elements 78. In this embodiment the design calls for three, but the actual number would be determined but such design factors as aesthetics and/or actual additional traction needs. Each dual embedded tensile member 70*a* through 70*c* has a centrally positioned perpendicularly convex angled tensile ridge 74. The perpendicular curve is perpendicular to the typical curved tensile members shown in the primary embodiment FIG. 4. The two, perpendicular, associated curved surfaces create what is considered a compound curved surface, which in turn adds more structural strength and even faster return from deforming forces than a single curved embedded tensile member would typically exhibit.

Figure 15A:
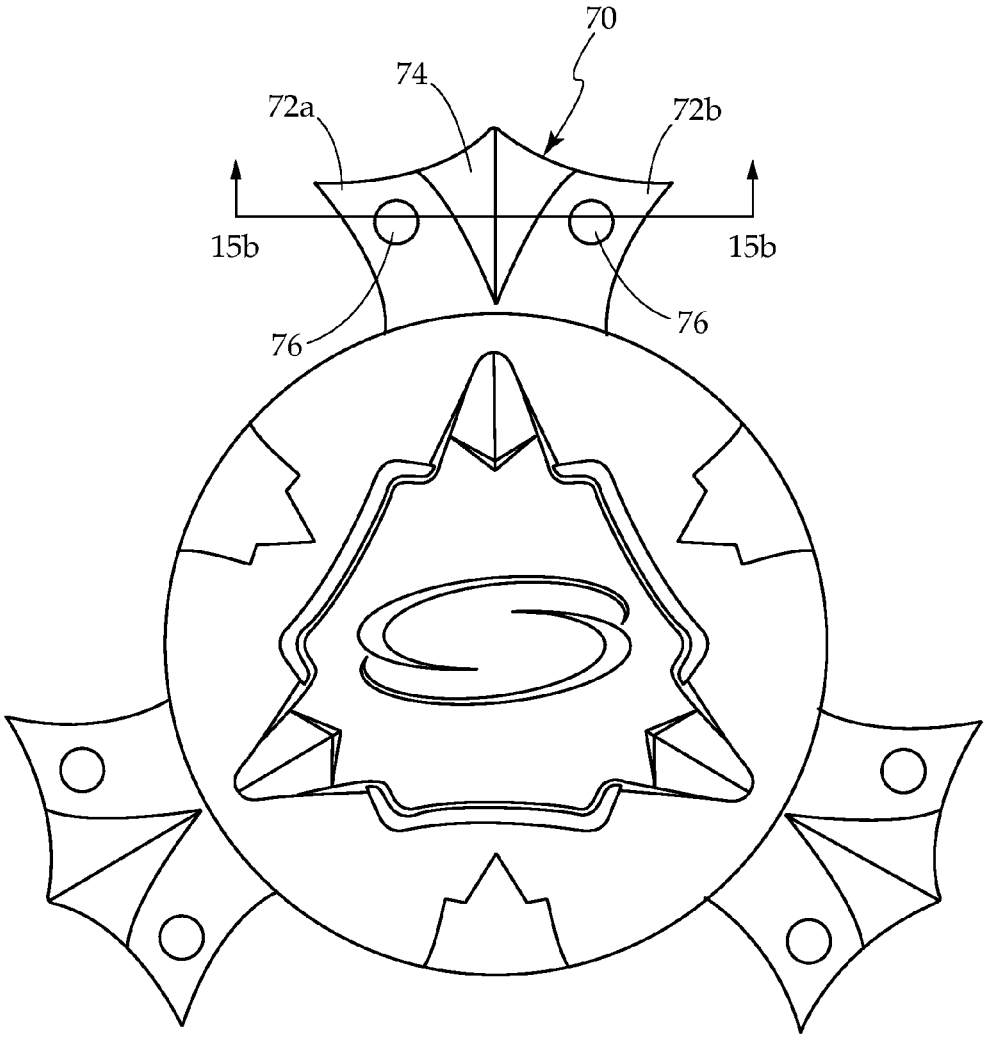
FIG. 15A shows the embedded tensile member of FIG. 14.

FIG. 15A illustrates a top view of the embedded tensile member unit 64 of the alternate embodiment dynamic cleat 60 shown in FIG. 14. The three wings that extend away from the center are the integral molded tensile members 72*a* through 72*c*. Shown along the surfaces of the tensile members is a plurality of integrally molded holes 76, in this embodiment one hole per corresponding dynamic traction element. The holes 76 replace the ridges 34 of the primary embodiment and perform essentially the same function; that of providing an additional mechanical bond to the already existed chemical bond created during the over-molding process. These mechanical bonds will assist the chemical bonds that will occur between the urethane and the nylon material on their contacting upper and lower surfaces.

Figure 15B:
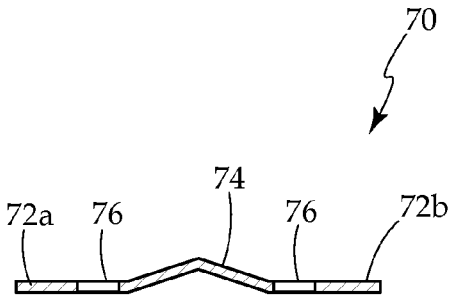
FIG. 15B is a cross section of one of the dynamic elements shown in FIG. 15A and taken along section line 15A-15A.

FIG. 15B illustrates a cross section of one of the dynamic elements 70 showing that the surface may be domed. The domed shape in area 74, which creates the compound curved surfaces that give the nylon portion a lot more energy to return to its original shape and also requires a lot more energy to deform, thus the dynamic element will spring up quickly. This type of cleat along with the cleat shown in FIG. 16 may be used for sports where the time interval between compressions is quicker than in walking i.e. sports where there is running such as soccer and football. This alternate embodiment allows the spike to be in its original position before every foot strike, which is virtually impossible with the return cycle time of current spikes.

Figure 16:
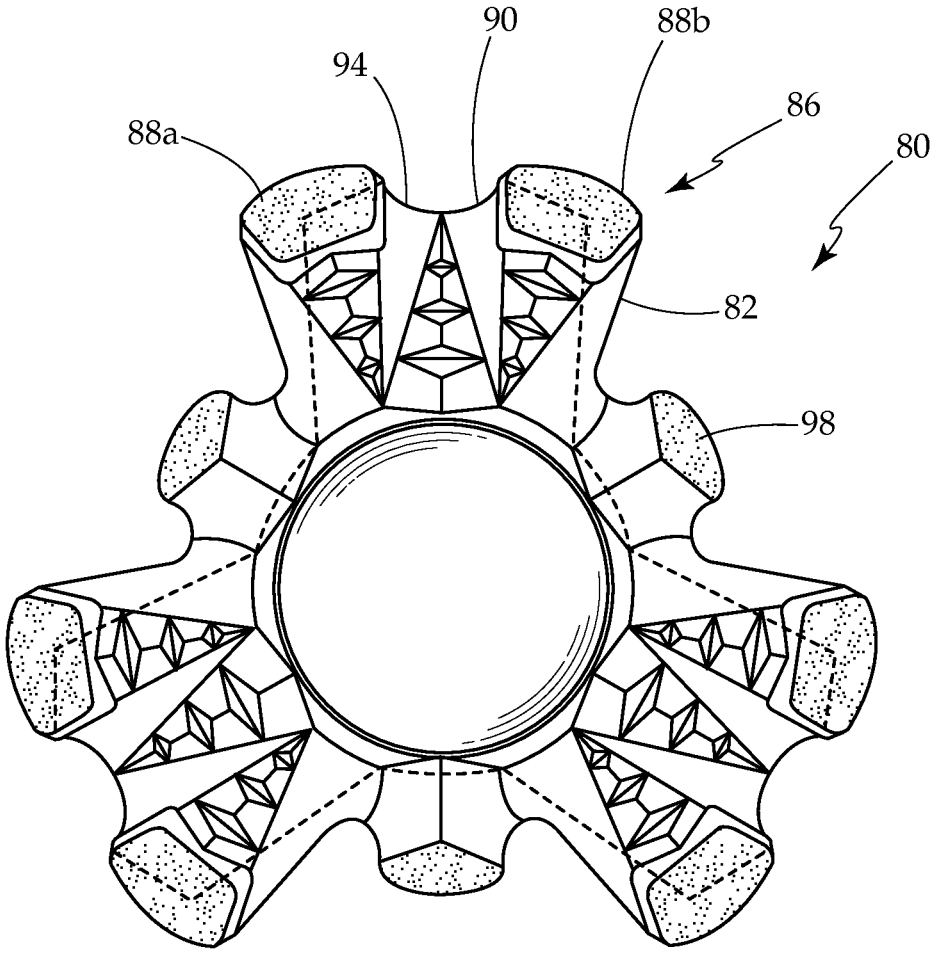
FIG. 16 shows still another alternate embodiment with six dynamic elements and three tensile members.

FIG. 16 illustrates a plan view of an alternate embodiment dynamic cleat 80 with an elastomeric flexible dynamic traction portion 82 having three dynamic element 88*a*, 88*b* and 88*c* over-molded onto three embedded tensile members, 90*a* through 90*c*, each of which, having dual, independent embedded tensile members units 92*a* and 92*b* that are embedded into corresponding dynamic element 88*a*, 88*b* and 88*c*. Also as part of the elastomeric overlay is a plurality of molded soft but static traction elements 98. In this embodiment the design calls for three, but the actual number would be determined but such design factors as aesthetics and/or actual additional traction needs. Each dual embedded tensile member 90*a* through 90*c* has a preferably centrally positioned perpendicularly concaved curved tensile ridge 94. The perpendicular curve is perpendicular to the typical curved tensile members shown in the primary embodiment of FIG. FIG. 4. The two, perpendicular associated curved surfaces, create what is considered a compound curved surface, which in turn adds more structural strength and even faster return from deforming forces than a single curved embedded tensile member would typically exhibit.

Figure 17A:
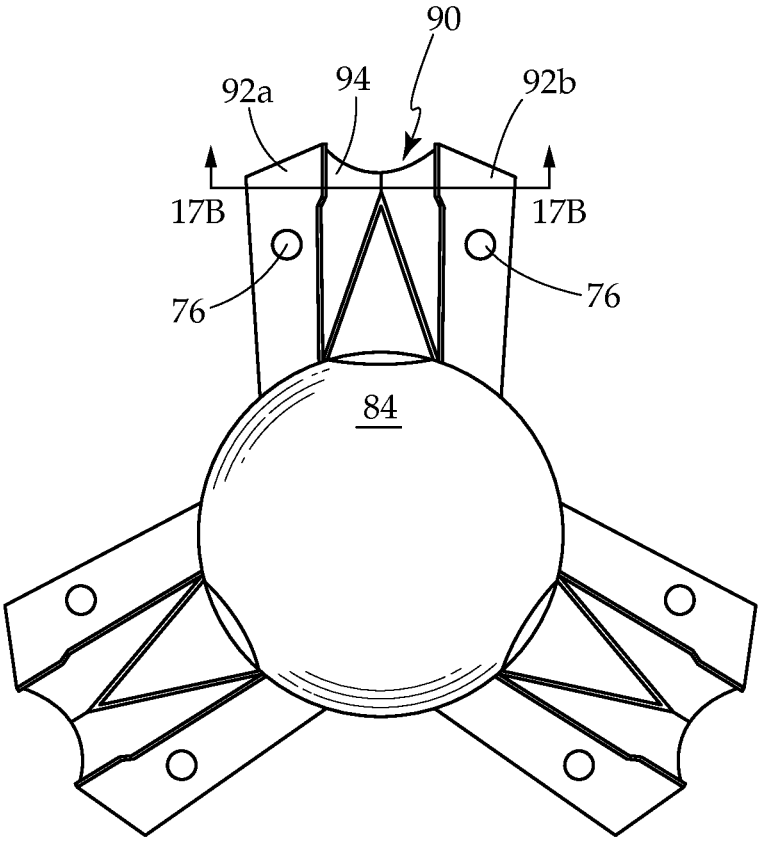
FIG. 17A shows the embedded tensile member of FIG. 16.

FIG. 17A illustrates a top view of the embedded tensile member unit 94 of the alternate embodiment dynamic cleat 80 shown in FIG. 14. The three wings that extend away from the center are the integral molded tensile members 92*a* through 92*c*. Shown along the surfaces of the tensile members is a plurality of integrally molded holes 76, in this case one hole per dynamic traction element. The holes 76 replace the ridges 34 of the primary embodiment and perform essentially the same function; that of providing an additional mechanical bond to the already existed chemical bond created during the over-molding process. These mechanical bonds will assist the chemical bonds that will occur between the urethane and the nylon material on their contacting upper and lower surfaces.

Figure 17B:
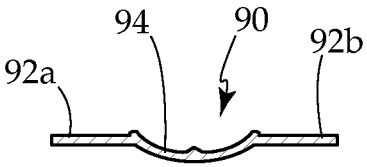
FIG. 17B is a cross section of one of the dynamic elements shown in FIG. 15A and taken along section line 17A-17A.

FIG. 17B illustrates a cross section of one of the dynamic elements 90 showing that the surface is of a convex domed shape. The convex domed shape in area 94, which creates the compound curved surfaces that give the nylon portion a lot more energy to return to its original shape and also requires a lot more energy to deform, thus the dynamic element will spring up quickly. This type of cleat and the cleat shown in FIG. 16 may be used for sports where the time interval between compressions is quicker than in walking i.e. sports where there is running such as soccer and football. This alternate embodiment allows the spike to be in its original position before every foot strike, which is virtually impossible with the return cycle time of current spikes.

In another embodiment, there is a single longitudinally flexible ridge area located longitudinally on the top surface of each flexible traction element, acting in the role of a tensile stress lens area. In a third embodiment, in the middle portion of each thin tensile member is a thickened end portion circular cutout hole running through the thin tensile member. The circular cutout hole adds additional bonding strength to help keep the embedded thin tensile member bonded in place, by adding mechanical strength in addition the chemical bonds created between the thin tensile member and the flexible traction element during the molding process. In a forth embodiment, both lateral raised ridges and circular cutout hole are used for added mechanical strength.

In another embodiment, the thermoplastic urethane may have a Shore A hardness of from about 55-A to 95-A, with about 85-A being a preferred hardness. The dynamic elastomeric cleat elements are integrally molded to and project in a radial manner outward from, a central hub portion. The central hub portion is formed of a rigid plastic material such as nylon 6/6 typically, having a Shore D hardness of from about 45-D to 80-D, with about 70-D being a preferred hardness. On the end of each thin tensile member is a thickened end portion running laterally across the thin tensile member end. The thickened portion adds additional bonding strength to help keep the embedded thin tensile member bonded in place, by adding mechanical strength in addition the chemical bonds created between the thin tensile member and the flexible traction element during the molding process. In one embodiment, there are two flexible ridge areas acting in the role of a tensile stress lens sections. These tensile stress lens sections are longitudinal in shape and are located on the upper surface area of the dynamic traction element. A single or plurality of lateral cutout areas act in the role of a compression stress lens sections on the lower surface area of the dynamic traction element.

I claim:

1. A footwear cleat comprising:

a central hub portion;

a plurality of dynamic traction elements, wherein each individual of the dynamic traction elements is disposed to extend substantially outwardly from the central hub portion and each individual of the plurality of dynamic traction elements comprises:

a tensile member, wherein each tensile member is disposed to be located within a corresponding individual of the plurality of dynamic traction elements; and a traction tooth area.

2. The footwear cleat of claim 1, wherein each tensile member is disposed to extend substantially outwardly and parallel to a corresponding individual of the plurality of the dynamic traction element from the central hub portion.

3. The footwear cleat of claim 1, wherein each tensile member further comprises a substantially raised end ridge.

4. The footwear cleat of claim 1, wherein the central hub portion further comprises a convex central wear area.

5. The footwear cleat of claim 1, wherein the plurality of dynamic traction elements comprise a substantially elastomeric material.

6. The footwear cleat of claim 1, wherein the plurality of dynamic traction elements are substantially equidistantly disposed about the circumference of the central hub portion.

7. The footwear cleat of claim 1, wherein each tensile member is chemically bonded to each associated surface of each corresponding individual of the plurality of dynamic traction elements in substantial contact with the tensile member.

8. The footwear cleat of claim 1, wherein each individual of the plurality of dynamic traction elements further comprises a plurality of lateral notches located substantially upon a compression side of each tensile member.

9. The footwear cleat of claim 1, wherein each tensile member further comprises an integrally molded cavity disposed to create a plurality of mechanical bonds between each tensile member and the corresponding individual of the plurality of dynamic traction elements.

10. The footwear cleat of claim 3, wherein each tensile member further comprises an integrally molded cavity disposed to create a plurality of mechanical bonds between each tensile member and the corresponding individual of the plurality of dynamic traction elements.

11. The footwear cleat of claim 4, wherein the convex central area is substantially composed of a high durometer disposed to provide a compression limit for the footwear cleat.

12. The footwear cleat of claim 1, wherein the plurality of dynamic traction elements are disposed to be substantially positioned at an angle downward in relation to a plane perpendicular to the center axis of the cleat to allow room for a quantity of deflection toward the shoe sole under a pressure load.

13. The footwear cleat of claim 1, wherein each tensile member is centrally located within the corresponding individual of the plurality of dynamic traction elements.

14. The footwear cleat of claim 1, wherein the plurality of dynamic traction elements further comprises a plurality of ridges and grooves substantially oriented to be integrally formed with each dynamic traction element.

15. A footwear cleat comprising:

a central hub portion, wherein the central hub portion includes a convex central wear area;

a plurality of dynamic traction elements, wherein each dynamic traction element is disposed to extend substantially outwardly from the central hub portion and each dynamic traction element further comprises:

a traction tooth area;

a plurality of lateral notches; and a tensile member, wherein each tensile member is located within a corresponding dynamic traction element, each tensile member further comprising:

a substantially raised end ridge.

16. A footwear cleat comprising:

a central hub portion;

a dynamic traction portion, wherein the dynamic traction portion includes three pairs of dynamic elements, each pair of elements extending outwardly from the central hub portion in a substantially curved orientation;

a plurality of pairs of tensile members, wherein each pair of tensile members corresponds to a pair of dynamic elements, and wherein each pair of tensile members is located within the dynamic traction portion; and, wherein the dynamic traction portion comprises dual independent embedded tensile members units substantially embedded into the three dynamic element pairs overmolded onto the three embedded tensile members.

17. The footwear cleat of claim 16 wherein said dynamic traction portion comprises an elastomeric flexible construction.

* * * * *